US009540824B1

(12) United States Patent
Sandburg

(10) Patent No.: US 9,540,824 B1
(45) Date of Patent: Jan. 10, 2017

(54) RETRACTABLE STAIRS AND CORD ASSEMBLY

(71) Applicant: Rodney A. Sandburg, Oklahoma City, OK (US)

(72) Inventor: Rodney A. Sandburg, Oklahoma City, OK (US)

( * ) Notice: Subject to any disclaimer, the term of this patent is extended or adjusted under 35 U.S.C. 154(b) by 34 days.

(21) Appl. No.: 14/731,976

(22) Filed: Jun. 5, 2015

(51) Int. Cl.

| | |
|---|---|
| ***E06C 9/00*** | (2006.01) |
| ***E04F 11/06*** | (2006.01) |
| ***E06C 9/08*** | (2006.01) |
| *E06C 9/10* | (2006.01) |

(52) U.S. Cl.
CPC ..... *E04F 11/064* (2013.01); *E06C 9/08* (2013.01); *E06C 9/085* (2013.01); *E06C 9/10* (2013.01)

(58) Field of Classification Search
CPC ..... E04F 11/064; E06C 1/383; E06C 9/08; E06C 9/085; E06C 9/10
See application file for complete search history.

(56) References Cited

U.S. PATENT DOCUMENTS

| | | | | | |
|---|---|---|---|---|---|
| 1,731,980 | A * | 10/1929 | Marschke | E04F 11/064 | 182/78 |
| 2,163,142 | A * | 6/1939 | Frazier | E04F 11/064 | 182/209 |
| 2,572,281 | A | 10/1951 | Pierce | | |
| 3,807,528 | A | 4/1974 | Frank | | |
| 3,871,479 | A * | 3/1975 | Pelto | A62B 5/00 | 182/106 |
| 3,982,608 | A * | 9/1976 | Booth | E06C 9/10 | 182/49 |
| 3,985,202 | A | 10/1976 | Harmon | | |
| 4,541,508 | A | 9/1985 | Lundh | | |
| 5,050,706 | A | 9/1991 | Cole | | |
| 5,407,261 | A | 4/1995 | Mercer | | |
| 6,662,901 | B1 | 12/2003 | Appl | | |
| 6,802,392 | B1 | 10/2004 | Davis | | |
| 6,866,118 | B1 | 3/2005 | Battenberg | | |
| 6,962,236 | B2 | 11/2005 | Penn | | |
| 7,587,866 | B1 * | 9/2009 | Perkins | E04F 11/064 | 182/78 |
| 7,841,448 | B2 * | 11/2010 | Lair | E06C 1/12 | 182/77 |
| 8,292,031 | B2 | 10/2012 | Penn | | |

(Continued)

*Primary Examiner* — Colleen M Chavchavadze
(74) *Attorney, Agent, or Firm* — Dunlap Codding, P.C.

(57) ABSTRACT

A ladder assembly is described. The ladder assembly includes a frame, a door, a ladder and a cord manipulation assembly. The frame at least partially surrounds a first opening. The door is movably connected to the frame. The door is configured to cover at least a portion of the first opening of the frame, the door defines a second opening. The ladder is connected to at least one of the frame and the door. The ladder has a first side rail, a second side rail spaced a distance apart laterally from the first side rail, and a plurality of rungs extending between the first and second side rails. The ladder is configured to be at least partially positioned within the first opening of the frame. The cord manipulation assembly is positioned between a pair of adjacently disposed rungs of the ladder. The cord manipulation assembly has a power source connector, a reel adapted to support a cord, a motor operatively connected to the reel and the power source connector, and a remote control transceiver assembly operatively connected to the motor and the power source connector.

22 Claims, 5 Drawing Sheets

(56) References Cited

U.S. PATENT DOCUMENTS

| | | | | |
|---|---|---|---|---|
| 8,579,081 | B2 | 11/2013 | Richey | |
| 8,997,411 | B2 * | 4/2015 | Whitten | E04F 11/062 52/183 |
| 2002/0112409 | A1 * | 8/2002 | Knowles | E04F 11/064 52/19 |
| 2005/0067223 | A1 * | 3/2005 | Penn | E04F 11/064 182/39 |
| 2009/0255757 | A1 * | 10/2009 | Burke | E04F 11/064 182/78 |
| 2010/0192487 | A1 | 8/2010 | Thornton | |
| 2012/0005972 | A1 * | 1/2012 | Burke | E04F 11/064 52/183 |

* cited by examiner

RETRACTABLE STAIRS AND CORD ASSEMBLY

BACKGROUND

Ladder assemblies which are positioned into an opening in a ceiling or a wall are known as shown, for example, in U.S. Pat. Nos. 2,907,401, 4,281,743, 4,541,508, 5,050,706, and 6,802,392. Ladder assemblies have been formed as foldable stowing stairways, collapsible stairways, and solid retractable stairways. Some of these ladder assemblies have articulated ladders with jointed side rails to enable the ladder to be stowed in an opening that is smaller than the full length of the ladders.

Ladder assemblies which retract, fold, or otherwise are at least partially positioned within an opening in a ceiling or wall often have an initial extraction mechanism by which to move a portion of the ladder assembly from the opening to a position at which a user may touch the ladder. These initial extraction mechanisms include cords, handles, and levers to ease the initial extraction of a ladder, especially in cases where the ladder is positioned in an opening where a user may not easily reach the ladder once the ladder has been retracted into the opening. These ladder assemblies leave the initial extraction mechanism extending downwardly from the ladder assembly so that the user may, at any time, access and use the ladder assembly.

SUMMARY

This summary is provided to introduce a selection of concepts that are further described in the detailed description. This summary is not intended to identify key or essential features of the claimed subject matter, nor is it intended to be used as an aid in limiting the scope of the claimed subject matter.

In one embodiment, a ladder assembly is described having a frame, a door movably connected to the frame, a ladder connected to at least one of the frame and the door, and a cord manipulation assembly positioned proximate to the ladder and the door. The frame at least partially surrounding a first opening. The door is movably connected to the frame. The door is configured to cover at least a portion of the first opening of the frame. The door defines a second opening. The ladder is connected to at least one of the frame and the door. The ladder has a first side rail, a second side rail spaced a distance apart laterally from the first side rail, and a plurality of rungs extending between the first and second side rails, the ladder is configured to be at least partially positioned within the first opening of the frame. The cord manipulation assembly is positioned between a pair of adjacently disposed rungs of the ladder, the cord manipulation assembly has a power source connector, a reel adapted to support a cord, a motor operatively connected to the reel and the power source connector, and a remote control transceiver assembly operatively connected to the motor and the power source connector.

In another version, the present disclosure describes a ladder assembly having a frame, a door, a plurality of ladder sections, and a cord manipulation assembly. The frame at least partially surrounds a first opening. The door is movably connected to the frame. The door has a first end proximate to the connection between the door and the frame and a second end opposite the first end. The door is configured to cover at least a portion of the opening of the frame. The door defines a second opening proximate to the second end of the door. The plurality of ladder sections are connected to one another and are positioned parallel to one another when in a folded position and substantially aligned when in an unfolded position. Each of the plurality of ladder sections has a first rail and a second rail, spaced a distance apart, and a plurality of rungs extending between the first rail and the second rail. A first ladder section of the plurality of ladder sections is connected to at least one of the at least one side of the frame and the door. The plurality of ladder sections is configured to be at least partially positioned within the first opening of the frame when in the folded position. The cord manipulation assembly is positioned between adjacently disposed rungs of the first ladder section and proximate to the second opening of the door. The cord manipulation assembly has a power source connector, a reel supporting a cord, a motor operatively connected to the reel and the power source connector, and a remote control transceiver assembly operatively connected to the motor and the power source connector.

In another embodiment, the present disclosure describes a ladder assembly kit having a frame, a door, a ladder, a cord manipulation assembly and a container. The frame at least partially surrounds a first opening. The door is movably connected to the frame. The door is configured to cover at least a portion of the first opening of the frame. The door defining a second opening. The ladder is connected to at least one of the frame and the door, the ladder has a first side rail, a second side rail spaced a distance apart laterally from the first side rail, and a plurality of rungs extending between the first and second side rails. The ladder is configured to be at least partially positioned within the first opening of the frame. The cord manipulation assembly is positioned between a pair of adjacently disposed rungs of the ladder. The cord manipulation assembly has a power source connector, a reel adapted to support a cord, a motor operatively connected to the reel and the power source connector, and a remote control transceiver assembly operatively connected to the motor and the power source connector. The container houses the frame, the ladder, the door, and the cord manipulation assembly.

BRIEF DESCRIPTION OF THE DRAWINGS

Certain embodiments of the inventive concepts will hereafter be described with reference to the accompanying drawings, wherein like reference numerals denote like elements. It should be understood, however, that the accompanying figures illustrate the various implementations described herein and are not meant to limit the scope of the various technologies described herein.

DETAILED DESCRIPTION

Specific embodiments of the inventive concepts disclosed herein will now be described in detail with reference to the accompanying drawings. Further, in the following detailed description of embodiments of the present disclosure, numerous specific details are set forth in order to provide a more thorough understanding of the disclosure. However, it will be apparent to one of ordinary skill in the art that the embodiments disclosed herein may be practiced without these specific details. In other instances, well-known features have not been described in detail to avoid unnecessarily complicating the description.

Unless expressly stated to the contrary, "or" refers to an inclusive or and not to an exclusive or. For example, a condition A or B is satisfied by anyone of the following: A is true (or present) and B is false (or not present), A is false (or not present) and B is true (or present), and both A and B are true (or present).

In addition, use of the "a" or "an" are employed to describe elements and components of the embodiments herein. This is done merely for convenience and to give a general sense of the inventive concept. This description should be read to include one or at least one and the singular also includes the plural unless otherwise stated.

The terminology and phraseology used herein is for descriptive purposes and should not be construed as limiting in scope. Language such as "including," "comprising," "having," "containing," or "involving," and variations thereof, is intended to be broad and encompass the subject matter listed thereafter, equivalents, and additional subject matter not recited or inherently present therein.

As used herein any references to "one embodiment," "an embodiment," or "some embodiments" means that a particular element, feature, structure, or characteristic described in connection with the embodiment is included in at least one embodiment. The appearances of the phrase "in one embodiment" in various places in the specification may not refer to the same embodiment.

Figure 1:
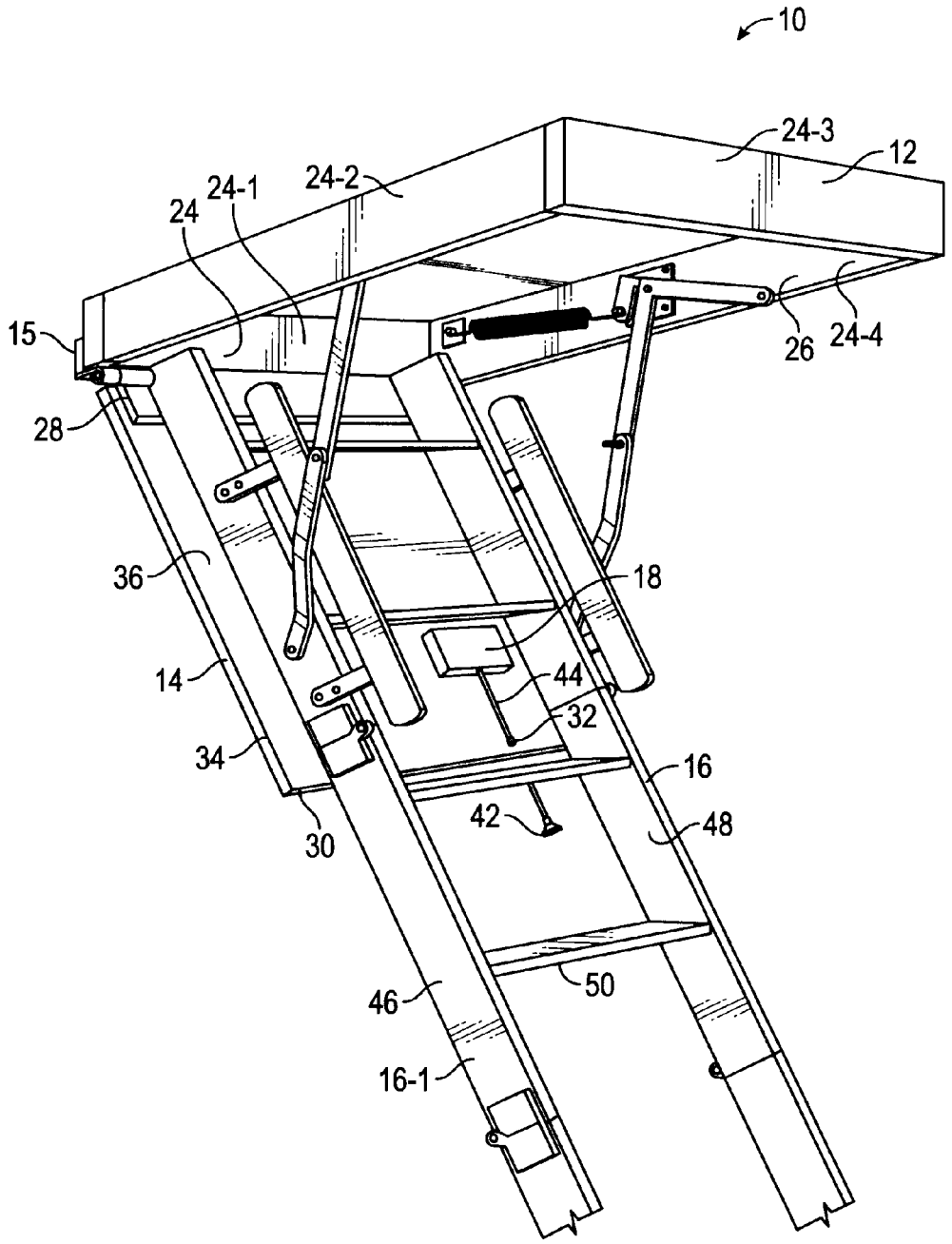
FIG. 1 is a perspective view of a ladder assembly in accordance with some embodiments of the present disclosure.
Figure 2:
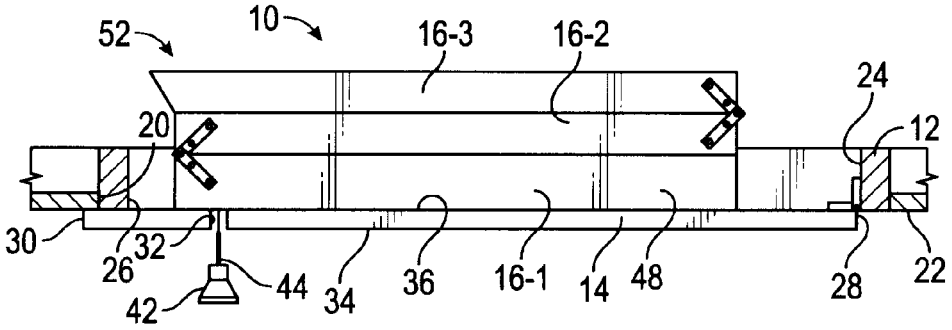
FIG. 2 is a side view of the ladder assembly of FIG. 1 in a folded position.
Figure 3:
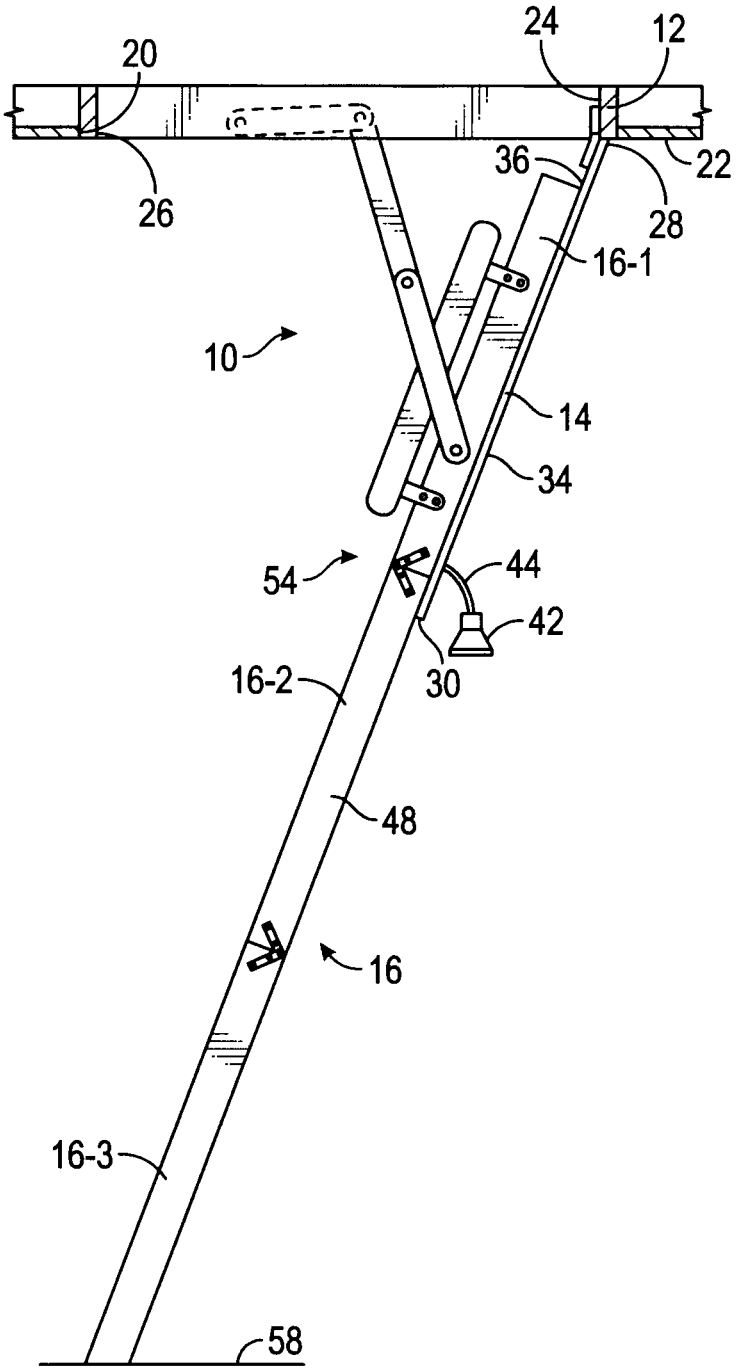
FIG. 3 is a side view of the ladder assembly of FIG. 1 in an unfolded position.

Referring now to FIGS. 1-3, therein shown is a ladder assembly 10 according to some embodiments of the present disclosure. The ladder assembly 10 includes a frame 12, a door 14 movably connected to the frame 12 via one or more hinge 15, a ladder 16 connected to at least one of the frame 12 and the door 14, and a cord manipulation assembly 18 positioned proximate to the ladder 16 and the door 14. The ladder assembly 10 may be configured such that at least a portion of the frame 12 may be positioned in an opening 20 (see FIG. 2) defined by a structure 22. For example, in some embodiments, the ladder assembly 10 may be configured for access to an attic where the structure 22 is framing for a ceiling and the opening 20 is defined within the ceiling separating an attic and an area below the attic. In some embodiments, the structure 22 may separate a loft area or a storage area from a living area or garage of a building, such as a house. In these embodiments, the structure 22 may be a wall or a ceiling.

The frame 12 may include at least one side 24 and at least partially surround an first opening 26. In some embodiments, the frame 12 may include a plurality of sides 24, such as four sides 24-1-24-4, which are connected together and completely surround the first opening 26. At least a portion of the ladder 16 (and preferably the entire ladder 16) may be positioned within the first opening 26 of the frame 12. The at least one side 24 of the frame 12 may be formed from wood, metal, plastic, or any other suitable material having sufficient strength and rigidity to support the ladder 16 and its load, such as from a user climbing the ladder 16, for example. In embodiments where the frame 12 has the plurality of sides 24, the plurality of sides 24 of the frame 12 may be formed from single piece construction or may be formed as distinct sections and connected together. For example, the plurality of sides 24 may be connected mechanically by screws, nails, nuts and bolts, brazing, welding, joinery, or any other suitable mechanical connection; by adhesives, such as glue, epoxies, or other suitable adhesives; or by a combination of mechanical connections and adhesives.

The door 14 may be movably connected to the at least one side 24 of the frame 12. For example, the door 14 may be connected to the at least one side 24 of the frame 12 via one or more hinge 15, one or more pivot joint, one or more sliding joint, or any other suitable connection. The door 14 may have a first end 28 proximate to the side 24-1 of the frame 12 and a second end 30 opposite the first end 28. The door 14 may be configured to cover at least a portion of the first opening 26 of the frame 12. The door 14 may define a second opening 32 proximate, e.g., within 5-6 inches from, the second end 30 of the door 14. The door 14 may be formed from wood, metal, plastic, composite materials, combinations thereof, or any suitable material. The second opening 32 may extend from a first surface 34 of the door 14 to a second surface 36 of the door 14.

Figure 2A:
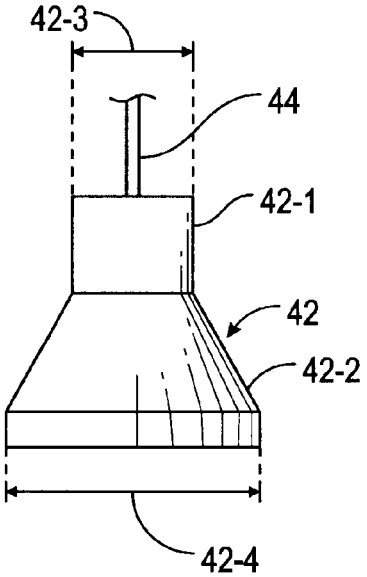
FIG. 2A is a side view of a pull connected to a cord in accordance with some of the embodiments of the present disclosure.

In some embodiments, as shown in FIG. 2A, the cord manipulation assembly 18 includes a knob 42 connected to a cord 44 extending through the second opening 32. The knob 42 may be provided with a shank 42-1, and a knob 42-2 that extends from the shank 42-1. The shank 42-1 has a first cross-sectional dimension 42-3 and the knob 42-2 has a second cross-sectional dimension 42-4. When the shank 42-1 is circular, the first-cross sectional dimension 42-3 can be a diameter. Likewise, when the knob 42-2 is circular, the second cross sectional dimension 42-4 can be a diameter. It should be understood that the shank 42-1 and/or the knob 42-2 do not have to be circular, but can be formed of other cross-sectional shapes such as an ellipse, a polygon or a fanciful shape. As shown in FIG. 2A, the knob 42-2 may extend outwardly from the shank 42-1 such that the second cross sectional dimension 42-4 is larger than the first cross sectional dimension 42-3. For example, the knob 42-2 may taper outwardly as shown in FIG. 2A.

Figure 2B:
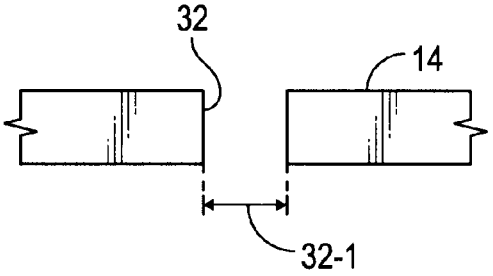
FIG. 2B is a sectional view of a door showing an opening formed therein in accordance with some of the embodiments of the present disclosure.

As shown in FIG. 2B, in some embodiments the second opening 32 has a third cross-sectional dimension 32-1. When the second opening 32 has a cylindrical or circular shape, the third cross-sectional dimension 32-1 can be a diameter. However, the second opening 32 can be formed with other shapes as well, such as a polygonal shape or a fanciful shape. In some embodiments, the second opening 32 is provided with a cylindrical shape, the shank 42-1 is provided with a cylindrical shape, and at least a portion of the knob 42-2 is provided with a frusto-conical shape. In these embodiments, the first cross-sectional dimension 42-3 is less than the third cross-sectional dimension 32-1 of the second opening 32 so that the shank 42-1 can be disposed within the second opening 32. The second cross-sectional dimension 42-4 can be greater than the first and third cross-sectional dimensions such that only a portion of the knob 42-2 may be positionable within the second opening 32. The frusto-conical shape of the portion of the knob 42-2 serves to center the knob 42-2 in the second opening 32.

The ladder 16 may be connected to at least one of the at least one side 24 of the frame 12 and the door 14. The ladder may have a first side rail 46, a second side rail 48 spaced a distance apart from the first side rail 46, and a plurality of rungs 50 extending between the first and second side rails 46 and 48. The ladder 16 may be configured to be at least partially positioned within the first opening 26 of the frame 12. In some embodiments, the first side rail 46 and the second side rail 48 may extend longitudinally away from the connection to at least one of the at least one side 24 of the frame 12 and the door 14. In these embodiments, the plurality of rungs 50 may extend transversely between the first side rail 46 and the second side rail 48 at approximately a 90 degree angle.

In some embodiments, as shown in FIGS. 1-3, the ladder 16 may include a plurality of ladder sections 16-1, 16-2, and 16-3, respectively. The plurality of ladder sections 16-1-16-3 may be substantially parallel to one another when in a folded position 52, as shown in FIG. 2. The plurality of ladder sections 16-1-16-3 may be sized and dimensioned such that when in the folded position 52, the ladder 16 is positionable within the first opening 26 of the frame 12. The plurality of ladder sections 16-1-16-3 may be substantially aligned with one another in an unfolded position 54, shown in FIG. 3, so that the ladder 16 extends from a floor 58 to the first opening 26 of the frame 12. As shown, the first side rail 46 and the second side rail 48 may be formed from wood, metal, plastic, or any combination thereof.

Figure 4:
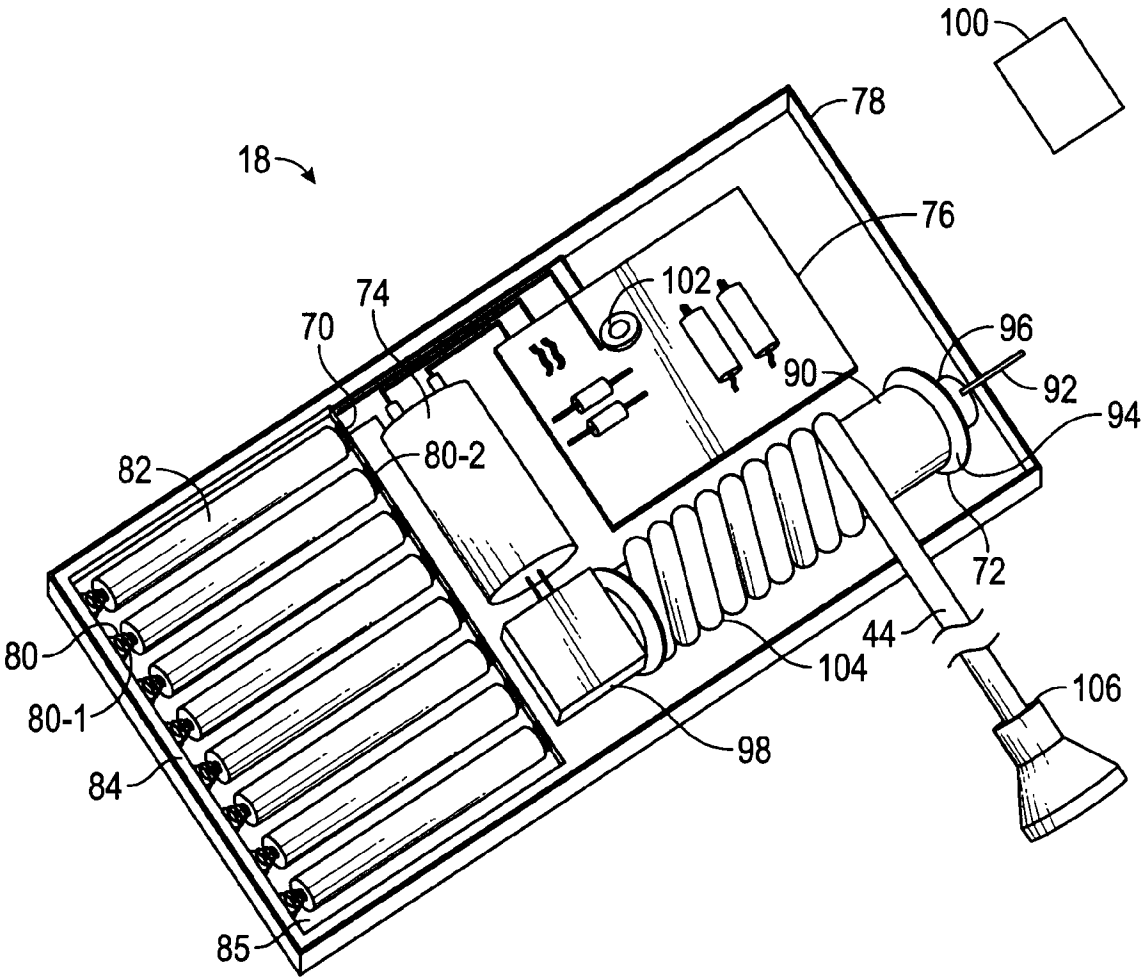
FIG. 4 is a perspective view of a cord manipulation assembly in accordance with some embodiments of the present disclosure.

Referring now to FIG. 4, therein shown is an example of the cord manipulation assembly 18 which may be positioned proximate to one of the plurality of rungs 50 of the ladder 16, and the door 14. The cord manipulation assembly 18 may include a power source connector 70, a reel 72, a motor 74 operatively connected to the reel 72 and the power source connector 70, and a remote control transceiver assembly 76 operatively connected to the motor 74 and the power source connector 70. In some embodiments, the cord manipulation assembly 18 may be positioned proximate to the second opening 32 and the second end 30 of the door 14. The cord manipulation assembly 18 may be connected to the door 14, one of the plurality of rungs 50, or to one of the first side rail 46 or the second side rail 48, in order to position the cord manipulation assembly 18 proximate to one of the plurality of rungs 50 of the ladder 16, and the door 14. In some embodiments, the cord manipulation assembly 18 may be at least partially encompassed by a first housing 78.

In some embodiments, the power source connector 70 may include two or more connectors 80 configured to contact one or more power source 82 and transfer energy from the one or more power source 82 to the motor 74 and the remote control transceiver assembly 76. The two or more connectors 80 of the power source connector 70 may connect to the motor 74 and the remote control transceiver assembly 76 via wires or any other suitable method. The two or more connectors 80 may be formed as electrical contacts 80-1 and 80-2, a plug, or any other suitable connectors enabling energy transfer from the one or more power source 82. The one or more power source 82 may be one or more individual battery, a plurality of batteries, a battery pack, a capacitor, or any other suitable power source or combination of power sources.

In some embodiments, the power source connector 70 may include a second housing 84 at least partially encompassing the two or more connectors 80. The second housing 84 may at least partially surround a bay 85 sized and configured to receive the one or more power source 82, such as a battery. The second housing 84 may be constructed in a manner or otherwise configured to receive and retain the one or more power source 82 such that the two or more connectors 80 may contact the one or more power source 82 and enable the transfer of energy from the one or more power source 82. In some embodiments the second housing 84 may be formed from plastic, composite materials, metal, or other suitable materials. The second housing 84 may include one or more sidewalls, and in some embodiments, a lid capable of securing to the one or more sidewalls so as to encapsulate or otherwise encompass the one or more power source 82 while the one or more power source 82 is in contact with the two or more connectors 80.

In some embodiments, the reel 72 may include a spindle 90 extending along an axis 92 and one or more retention wall 94 extending outwardly from the spindle 90. In some embodiments the one or more retention wall 94 may extend substantially perpendicularly to the axis 92 extending along the spindle 90. The spindle 90 may be implemented as a solid shaft, a tubular member, or any other suitable core around which the cord 44 may be wound. The spindle 90 may have a circular cross section or a polygonal cross section, such as a cross section in the shape of a triangle, square, pentagon, hexagon, or any other suitable polygon. The spindle 90 may also include an anchor (not shown) to which one end of the cord 44 may be connected to enable the cord 44 to be secured to the spindle 90 such that the cord 44 can be wound and unwound without being removed from the spindle 90. The anchor may be any suitable connection point, such as an opening extending through the spindle 90 through which the cord 44 may be extended and tied. In some embodiments, the anchor may be a raised or lowered section of the spindle 90 with a shaft extending between opposing sides of the raised or lowered section creating a point at which the cord 44 may be tied or otherwise connected to the spindle 90. The spindle 90 and the one or more retention wall 94 may be rotatable about the axis 92 such that the cord 44 may be unwound from the reel 72 via rotation of the spindle 90 of the reel 72 in a first direction. The spindle 90 and the one or more retention wall 94 may be rotatable about the axis 92 in a second direction, opposite to the first direction, in order to wind the cord 44 around the spindle 90.

In some embodiments, the reel 72 may be connected to the first housing 78 of the cord manipulation assembly 18, while the reel 72 may be connected to and supported by the first housing 78, in other embodiments the reel 72 may be connected to and supported by one of the plurality of rungs 50, the first side rail 46, the second side rail 48, or the door 14 in other embodiments. The reel 72 may be connected to one of the above-referenced elements by any suitable mechanism 96, such as a bracket or one or more arms extending outwardly from the reel 72, for example.

The reel 72 may also be operatively connected to the motor 74. In some embodiments, the reel 72 may be directly connected to a drive shaft of the motor 74, for example. In some embodiments, the reel 72 may be connected to the motor 74 via a mechanical translation assembly 98 to translate mechanical force from the motor 74 to the spindle 90 of the reel 72 in order to rotate the spindle 90 about the axis 92. In some embodiments, for example, the mechanical translation assembly 98 may be implemented as one or more gears, for example in a gearbox assembly, engaging at least a portion of the motor 74 and at least a portion of the reel 72. In some embodiments, the mechanical translation assembly 98 may engage the spindle 90 or at least a portion of the one or more retention wall 94 connected to the spindle 90, in order to translate the mechanical force generated by the motor 74 to the reel 72. Essentially, the mechanical translation assembly 98 may be configured to cause rotation of the reel 72 in a selected direction upon activation of the motor 74.

The motor 74 may be connected to and supported by the first housing 78, one of the plurality of rungs 50, the first side rail 46, the second side rail 48, or the door 14. The motor 74 may be any suitable motor capable of producing sufficient force to cause the reel 72 to rotate about the axis 92 to unwind and wind the cord 44 when supplied with power from the one or more power source 82. For example, the motor 74 may be an electric motor such as a DC motor. In at least some embodiments, the motor 74 may be compact such that the dimensions of the motor 74 fit within the first housing 78 of the cord manipulation assembly 18. In some embodiments, the motor 74 may have a separate power source (not shown) from the one or more power source 82 connected to the power source connector 70. In some embodiments, where the motor 74 has a separate power source, the motor 74 and the separate power source may be sized and dimensioned to be housed within the first housing 78 of the cord manipulation assembly 18.

The remote control transceiver assembly 76 may be operatively connected to the motor 74 and the power source connector 70. For example, the remote control transceiver assembly 76 may be connected to the power source connector 70 such that power from the one or more power source 82 may be transferred via the power source connector 70, thereby enabling the remote control transceiver assembly 76 to receive one or more signal from a remote control 100 and transmit one or more signal to the motor 74. The remote control 100 may be configured to generate and transmit a signal which may cause the remote control transceiver assembly 76 to actuate the motor 74 to extend or retract the cord 44 connected to the reel 72. For example, the remote control transceiver assembly 76 may be connected to the motor 74 such that when the remote control transceiver assembly 76 receives a signal from the remote control 100, the remote control transceiver assembly 76 may transmit a signal, by a wireless or wired communication channel, to a relay, not shown, (or other switching mechanism) which supplies power having a selected polarity to cause the motor 74 to rotate the reel 72 to wind or unwind the cord 44 about the spindle 90. The remote control transceiver assembly 76 may be any suitable remote control transceiver such as those associated with remote control toys or garage doors, for example.

In some embodiments, the cord manipulation assembly 18 may include a power indicator 102. The power indicator 102 may include circuitry that is configured to ensure that the cord 44 can be used to lower the ladder 16 from the opening 20. For example, the power indicator 102 may generate and send a signal to motor 74 to extend the cord 44 when available power within the one or more power source 82 has fallen below a predetermined level. Or, the power indicator 102 may generate an alert when available power within the one or more power source 82, attached to the power source connector 70, has fallen below a predetermined level. The power indicator 102 may provide the alert via any suitable manner, such as a light source, a sound source, or a wireless transmitter, for example, that transmits a wireless signal to a wireless device, such as a mobile phone, a tablet, a laptop, or any other suitable device capable of receiving, decoding and acting upon a wirelessly transmitted signal.

The cord 44 may have a first end 104 connected to the reel 72 and a second end 106 configured to extend through the second opening 32 of the door 14. In some embodiments, the knob 42 may be connected to the cord 44. The cord 44 may be formed from twine, string, rope, chain, wire, braided materials, plastic, or any other suitable material capable of translating force from a user to the spindle 90 for moving the door 14 generally toward the user.

Figure 5:
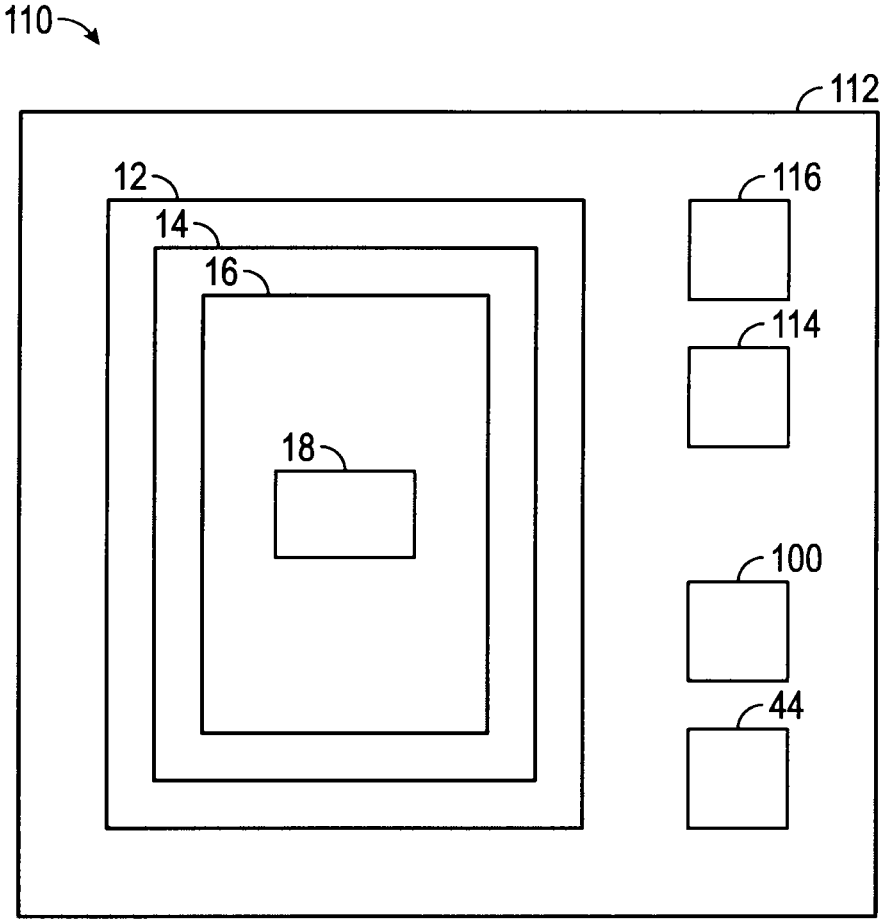
FIG. 5 is a diagrammatic view of a ladder assembly kit in accordance with some embodiments of the present disclosure.

Referring now to FIG. 5, shown therein is a ladder assembly kit 110 in accordance with some embodiments of the present description. The ladder assembly kit 110 may include the frame 12, the door 14, the ladder 16, the cord manipulation assembly 18, and a container 112 housing the frame 12, the door 14, the ladder 16, and the cord manipulation assembly 18. In some embodiments, the ladder assembly kit 110 may include the cord 44, which may be positioned within the container 112. In some embodiments, the ladder assembly kit 110 may further contain the remote control 100, which may be positioned within the container 112. The ladder assembly kit 110 may have a plurality of connection members 114, housed within the container 112. The plurality of connection members 114 may include screws, nails, nuts, bolts, or any other suitable connection member capable of being used to secure the ladder assembly 10 to a building. In some embodiments, the frame 12, the door 14, the ladder 16, and the cord manipulation assembly 18 may be positioned within the container 112 in an assembled state. In some embodiments, the frame 12, the door 14, the ladder 16, and the cord manipulation assembly 18 may be positioned within the container in an unassembled state, requiring at least partial assembly after removal from the container 112. An instruction set 116 may also be included within the container 112 describing one or more set of procedures for assembling and/or installing the ladder assembly 10 in the opening 20 of the structure 22. The container 112 can be a box made from any suitable material, such as paper, plastic or cardboard.

In use, a user uses the remote control 100 to cause the cord manipulation assembly 18 to lower the knob 42 so that the user can grasp the knob 42 to lower the door 14 and use the ladder 16. Thereafter, the user grasps the knob 42 and the door 14 and then raises the door 14 to position the ladder 16 back into the opening 20. When the door 14 is raised and seated next to the ceiling, the user uses the remote control 100 to cause the cord manipulation assembly 18 to raise the knob 42 until the knob 42 is seated in the second opening 32.

Although the preceding description has been described herein with reference to particular means, materials and embodiments, it is not intended to be limited to the particulars disclosed herein; rather, it extends to functionally equivalent structures, methods, and uses, such as are within the scope of the appended claims.

What is claimed is:

1. A ladder assembly, comprising:

a frame at least partially surrounding a first opening;

a door movably connected to the frame, the door configured to cover at least a portion of the first opening of the frame, the door defining a second opening;

a ladder connected to at least one of the frame and the door, the ladder having a first side rail, a second side rail spaced a distance apart laterally from the first side rail, and a plurality of rungs extending between the first and second side rails, the ladder configured to be at least partially positioned within the first opening of the frame; and a cord manipulation assembly, positioned between a pair of adjacently disposed rungs of the ladder, the cord manipulation assembly having a power source connector, a reel adapted to support a cord, a motor operatively connected to the reel and the power source connector, and a remote control transceiver assembly operatively connected to the motor and the power source connector; wherein the cord manipulation assembly further comprises the cord connected to the reel and extending through the second opening of the door.

2. The ladder assembly of claim 1, wherein the ladder further comprises a plurality of ladder sections, the plurality of ladder sections being substantially parallel to one another when in a folded position and substantially aligned with one another when in an unfolded position to create the ladder extendable from a floor to the opening of the frame.

3. The ladder assembly of claim 1, wherein the first side rail and the second side rail are configured to be collapsed to reduce a length of the first side rail and the second side rail when the ladder is positioned within the opening of the frame.

4. The ladder assembly of claim 1, wherein the cord manipulation assembly further includes a power indicator configured to generate an alert when available power within a power source, attached to the power source connector, has fallen below a predetermined level.

5. The ladder assembly of claim 1, wherein the cord manipulation assembly includes a power indicator configured to generate and send a signal to the motor to extend the cord when available power from the power source connector has fallen below a predetermined level.

6. The ladder assembly of claim 1, wherein the cord manipulation assembly further comprises a mechanical translation assembly operatively connected to the motor and the reel, the mechanical translation assembly configured to cause rotation of the reel in a user selectable direction upon activation of the motor.

7. The ladder assembly of claim 1, wherein the power source connector includes a bay sized and configured to receive a battery.

8. The ladder assembly of claim 1, further comprising a remote control configured to generate and transmit a signal which causes the remote control transceiver assembly to actuate the motor to rotate the reel.

9. The ladder assembly of claim 1, wherein the second opening has a first cross-sectional dimension, and wherein the cord manipulation assembly further comprises a weight connected to the cord, the door having a first surface and a second surface opposite the first surface, the cord manipulation assembly being positioned on the second surface of the door, and the weight being positioned on the first surface of the door, the weight having a second cross-sectional dimension larger than the first cross-sectional dimension so as to prevent the cord from being completely retracted through the second opening of the door.

10. A ladder assembly, comprising:

a frame at least partially surrounding a first opening;

a door movably connected to the frame, the door having a first end proximate to the connection between the door and the frame and a second end opposite the first end, the door configured to cover at least a portion of the first opening of the frame, the door defining a second opening proximate to the second end of the door;

a plurality of ladder sections, connected to one another, the plurality of ladder sections positioned parallel to one another when in a folded position and substantially aligned, to form a ladder, when in an unfolded position, each of the plurality of ladder sections having a first rail and a second rail, spaced a distance apart, and a plurality of rungs extending between the first rail and the second rail, a first ladder section of the plurality of ladder sections connected to at least one of the at least one side of the frame and the door, the plurality of ladder sections configured to be at least partially positioned within the first opening of the frame when in the folded position; and a cord manipulation assembly, positioned between adjacently disposed rungs of the first ladder section and proximate to the second opening of the door, the cord manipulation assembly having a power source connector, a reel supporting a cord, a motor operatively connected to the reel and the power source connector, and a remote control transceiver assembly operatively connected to the motor and the power source connector; wherein the cord manipulation assembly further comprises the cord connected to the reel and extending through the second opening of the door.

11. The ladder assembly of claim 10, wherein the cord manipulation assembly further includes a power indicator configured to generate an alert when available power within a power source, connected to the power source connector, has fallen below a predetermined level.

12. The ladder assembly of claim 10, wherein the cord manipulation assembly further comprises a mechanical translation assembly operatively connected to the motor and the reel, the mechanical translation assembly configured to cause rotation of the reel in a selected direction upon activation of the motor.

13. The ladder assembly of claim 10, wherein the power source connector includes a bay sized and configured to receive a battery.

14. The ladder assembly of claim 10 further comprising a remote control configured to generate a signal which causes the remote control transceiver assembly to actuate the motor to cause rotation of the reel in a selected direction.

15. The ladder assembly of claim 10, wherein the second opening has a first cross-sectional dimension, and wherein the cord manipulation assembly further comprises a weight connected to the cord, the door having a first surface and a second surface, the cord manipulation assembly being positioned on the second surface of the door, and the weight being positioned on the first surface of the door, the weight having a second cross-sectional dimension larger than the first cross-sectional dimension so as to prevent the cord from being completely retracted through the second opening of the door.

16. A ladder assembly kit, comprising:

a frame at least partially surrounding a first opening;

a door movably connected to the frame, the door configured to cover at least a portion of the first opening of the frame, the door defining a second opening;

a ladder connected to at least one of the frame and the door, the ladder having a first side rail, a second side rail spaced a distance apart laterally from the first side rail, and a plurality of rungs extending between the first and second side rails, the ladder configured to be at least partially positioned within the first opening of the frame;

a cord manipulation assembly, positioned between a pair of adjacently disposed rungs of the ladder, the cord manipulation assembly having a power source connector, a reel adapted to support a cord, a motor operatively connected to the reel and the power source connector, and a remote control transceiver assembly operatively connected to the motor and the power source connector; wherein the cord manipulation assembly further comprises the cord connected to the reel and extending through the second opening of the door; and a container housing the frame, the ladder, the door, and the cord manipulation assembly.

17. The ladder assembly kit of claim 16, wherein the cord manipulation assembly further includes a power indicator configured to generate an alert when available power within a power source, connected to the power source connector, has fallen below a predetermined level.

18. The ladder assembly kit of claim 16, wherein the cord manipulation assembly further comprises a gearbox assembly operatively connected to the motor and the reel, the gearbox assembly configured to cause rotation of the reel in a selected direction upon activation of the motor.

19. The ladder assembly kit of claim 16, wherein the power source connector includes a bay sized and configured to receive a battery.

20. The ladder assembly kit of claim 16 further comprising a remote control configured to generate and transmit a signal which causes the remote control transceiver assembly to actuate the motor to extend or retract the cord connected to the reel.

21. The ladder assembly kit of claim 20, wherein the container further houses the remote control.

22. The ladder assembly kit of claim 16, wherein the second opening has a first cross-sectional dimension, and wherein the cord manipulation assembly further comprises a weight connected to the cord, the door having a first surface and a second surface, the cord manipulation assembly being positioned on the second surface of the door, and the weight being positioned on the first surface of the door, the weight having a second cross-sectional dimension larger than the first cross-sectional dimension so as to prevent the cord from being completely retracted through the second opening of the door.

* * * * *